US008422726B2

(12) United States Patent
Lemarquand et al.

(10) Patent No.: US 8,422,726 B2
(45) Date of Patent: Apr. 16, 2013

(54) IRONLESS AND LEAKAGE FREE COIL TRANSDUCER MOTOR ASSEMBLY

(75) Inventors: Guy Lemarquand, Le Mans (FR); Mathias Remy, Villiers-le-Bâcle (FR); Gaël Guyader, Chaudon (FR)

(73) Assignees: Renault S.A.S. (FR); Universite du Maine (FR)

( * ) Notice: Subject to any disclaimer, the term of this patent is extended or adjusted under 35 U.S.C. 154(b) by 200 days.

(21) Appl. No.: 12/989,849

(22) PCT Filed: Apr. 29, 2009

(86) PCT No.: PCT/EP2009/055218

§ 371 (c)(1),
(2), (4) Date: Dec. 17, 2010

(87) PCT Pub. No.: WO2009/133149

PCT Pub. Date: Nov. 5, 2009

(65) Prior Publication Data

US 2011/0110549 A1 May 12, 2011

(30) Foreign Application Priority Data

Apr. 30, 2008 (EP) ..... 08103799

(51) Int. Cl.
*H04R 1/02* (2006.01)
*H04R 9/06* (2006.01)
*H04R 11/02* (2006.01)

(52) U.S. Cl.
USPC ..... 381/421; 381/412; 381/419

(58) Field of Classification Search ..... 381/412, 381/419, 421
See application file for complete search history.

(56) References Cited

U.S. PATENT DOCUMENTS

| | | | | |
|---|---|---|---|---|
| 4,017,694 | A * | 4/1977 | King | 381/415 |
| 5,317,228 | A | 5/1994 | Leupold | |
| 5,634,263 | A | 6/1997 | Leupold | |
| 5,715,324 | A | 2/1998 | Tanabe et al. | |
| 6,680,663 | B1 | 1/2004 | Lee et al. | |
| 7,197,155 | B2 * | 3/2007 | Bank | 381/421 |
| 2005/0179326 | A1 | 8/2005 | Moro | |
| 2009/0028375 | A1 * | 1/2009 | Richoux et al. | 381/412 |

FOREIGN PATENT DOCUMENTS

| | | | |
|---|---|---|---|
| FR | 2892886 | A | 5/2007 |
| GB | 2314799 | A | 1/1998 |
| WO | WO 94/03026 | A | 2/1994 |

OTHER PUBLICATIONS

Guy Lemarquand: "New structure of loudspeaker" AES Convention Paper, [Online] May 2006, pp. 1-4, XP002495237 Paris. Retrieved from the Internet: URL: http://www.aes.org/e-lib/browse.cfm?elib=13650> [retrieved on Sep. 8, 2008] abstract; figure 1 paragraph [0002].

(Continued)

*Primary Examiner* — Brian Ensey
(74) *Attorney, Agent, or Firm* — Ostrolenk Faber LLP

(57) ABSTRACT

The present disclosure relates to a coil transducer motor structure (20) including at least one coil (22), at least one magnetic element (23) arranged in use to provide a path for magnetic flux between the ends of said coil (22), wherein the magnetic element (23) has a structure providing a curvilinear path therethrough for said magnetic flux.

15 Claims, 4 Drawing Sheets

OTHER PUBLICATIONS

Blache C et al: "Linear displacement sensor with high magnetic field gradient" Journal of Magnetism and Magnetic Materials, Elsevier Science Publishers, Amsterdam, NL, vol. 104-107, Feb. 2, 1992, pp. 1106-1108, XP024536196 ISSN: 0304-8853 [retrieved on Feb. 2, 1992] the whole document.

Remy M et al: "Ironless and Leakage Free Voice-Coil Motor Made of Bonded Magnets" IEEE Transactions on Magnetics, IEEE Service Center, New York, NY, US, vol. 44, No. 11, Nov. 1, 2008, pp. 4289-4292, XP011240296 ISSN: 0018-9464 the whole document.

* cited by examiner

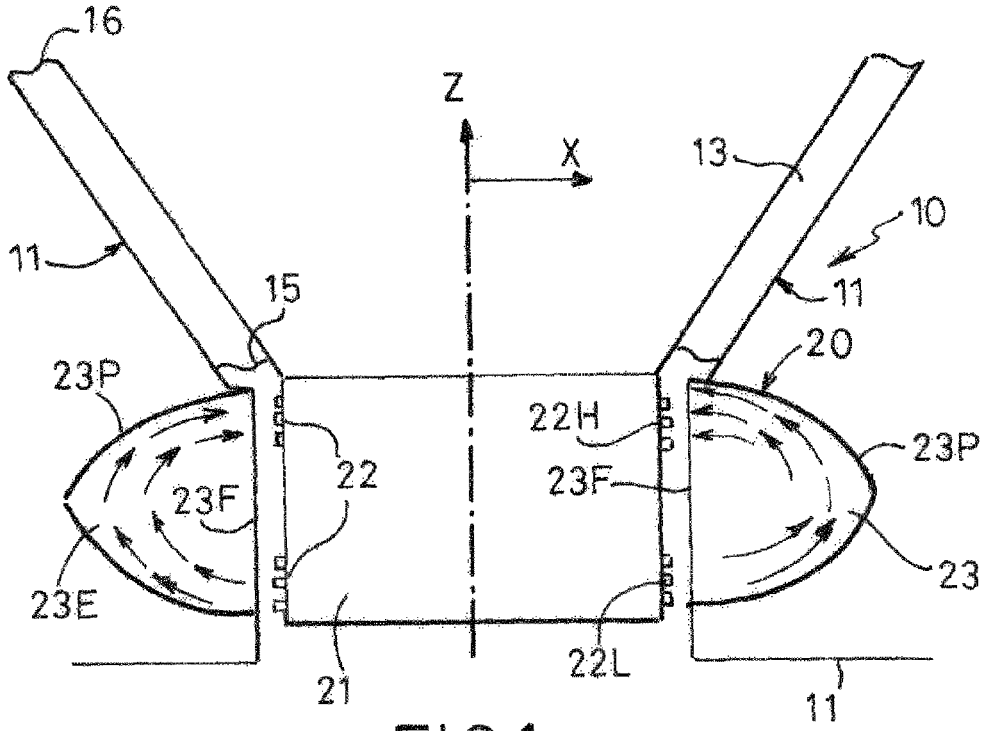
FIG.1
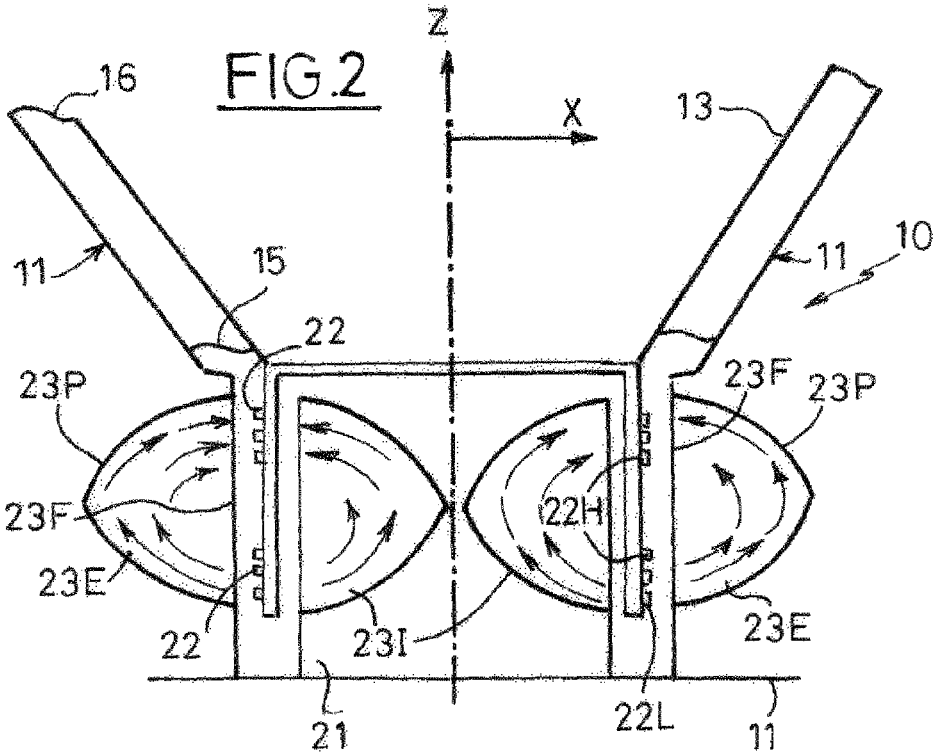

IRONLESS AND LEAKAGE FREE COIL TRANSDUCER MOTOR ASSEMBLY

CROSS REFERENCE TO RELATED APPLICATIONS

The present application is a 35 U.S.C. §371 National Phase conversion of PCT/EP2009/055218, filed Apr. 29, 2009, which claims benefit of European Application No. 08103799.6, filed Apr. 30, 2008, the disclosure of which is incorporated herein by reference. The PCT International Application was published in the English language.

BACKGROUND OF THE INVENTION

This invention relates to coil transducer motor assemblies and particularly to ironless and leakage free coil transducer motor assemblies.

This invention is disclosed in the context of a moving voice-coil transducer motor assembly for a loudspeaker. However, it is believed to be useful in other applications such as microphones, geophones, and shakers.

Voice-coil transducer motor assemblies, such as those used in traditional electrodynamic loudspeakers comprising magnetic field generating means adapted to generate a magnetic field in which a coil fixed on a moving part can be driven by a driving current in order to induce vibrations to a diaphragm connected to the moving part to produce sound, present a number of well-known drawbacks.

First, the presence of iron spacers, that usually comprise so called rear and front plates and a pole piece to help control the magnetic field characteristics in such motors leads to several kinds of nonlinearities. These include Eddy currents, the magnetic saturation of the iron and the variation of the coil inductance with its position causing a reluctant effect. However, it is desirable for the force applied on the moving part to be an image of the driving current. The driving forces applied on the moving part of the loudspeaker can be written as follows:

$$F_{driv} = F_L + F_r = Bli + \frac{1}{2}\frac{dL}{dx}i^2 \qquad \text{Equation (1)}$$

Where $F_L$ is the Laplace force, $F_r$ the reluctant force, B the induction seen by the voice-coil, l the length of the coil, i the driving current flowing through the coil, L the inductance of the coil and x the displacement of the coil. Thus, equation (1) shows that if the inductance of the coil varies, a reluctant force, proportional to $i^2$, occurs and interferes with the Laplace force. This reluctant force creates a force distortion resulting directly in an audible acoustical distortion.

Second, a significant part of the magnetic field created by most loudspeaker motors does not contribute towards making the diaphragm move. In addition to a simple loss of magnetic field, this leakage flux can be attracted by any ferromagnetic object placed nearby, leading to a decrease of the device efficiency. Reciprocally, this leakage magnetic field can prevent some devices placed nearby from working properly.

In order to solve these problems, several structures of ironless coil transducer motor assemblies have been proposed, one example of which is disclosed in the patent document FR2892886.

This disclosed assembly comprises a plurality of sintered permanent magnets arranged in such a way that the magnetization is always parallel to the outer edge. The perpendicular arrangement of the magnets leads to the generation of a magnetic field by the motor that is focused on the coil path without the use of iron spacers to focus and guide the magnetic field. The inductance of the coil no longer depends on its position, resulting in the vanishing of the reluctant force and the other nonlinearities due to iron that were listed previously. In addition, the inductance is diminished and consequently, so is the electrical impedance, especially at high frequencies.

However, although some field leakage is prevented in comparison with a traditional coil transducer motor assemblies comprising iron spacers, it is still a drawback that these assemblies have magnetic field leakage especially towards the external parts of the assembly, that prevent integration of such assemblies in close neighborhood of other electrical devices.

Another problem of this ironless coil transducer motor assembly is that the structure made of sintered magnets is difficult to assemble, as it requires the manufacture of magnet rings with distinct magnetization directions especially for the radially magnetized magnet rings and to have them sintered together.

These two problems are emphasized the more the dimensions of the loudspeaker are reduced.

SUMMARY OF THE INVENTION

It is an object of the invention to provide an improved ironless coil transducer motor assembly and in particular, an ironless coil transducer motor assembly that is leakage free.

Thereto, the present invention provides an ironless coil transducer motor assembly.

By providing a structure to the magnetic element such as it can provide a curvilinear path therethrough, the magnetization can be made in such a way that the magnetic field lines follow in any point the curve of the structure and leakage of the magnetic field can be prevented within and outside of the ironless coil transducer motor assembly, and especially towards an external direction.

Further advantageous features of the invention are disclosed in the dependant claims:

- said curvilinear path may be hemi-ellipsoidal;
- said magnetic element may be hemi-ellipsoidal in a [x-z] plane view cross-section, that provides a more compact transducer along the z-component;
- said hemi-ellipsoidal path or structure in cross-section may have a ratio R of 2 between the lengths of the major axis b and the minor axis h; that provides, to offer a good compromise between magnetic field intensity and the magnet element volume;
- said curvilinear path may be hemi-circular;
- said magnetic structure may be hemi-circular in a [x-z] plane view cross-section, that provides a more compact transducer along the x-component;
- the magnetic element may be magnetized in such a manner that said magnetic path is always substantially tangential to a peripheral edge of said magnetic element, except on the side facing the coil, where it is perpendicular to the edge of the coil-facing face, that provides a high concentration of the magnetic field around the coil;
- the magnetic element may comprise a bonded magnetic structure, that is easier to assemble;
- a preforming molding die, adapted to contain the material constituting the bonded magnet element (23), may be made of a non-magnetic material or a soft-magnetic material or a combination thereof to ensure that a high magnetic field can enter into the mold without any disturbance;

magnetization of the magnetic element may be realized when the material constituting the bonded magnet is still liquid;

the bonded magnet element may comprise a rare-earth material based alloy and may be preferably chosen between Nd—Fe—B, Sm—Co and Sm—Fe—N;

the coil motor transducer structure may further comprise a moving part, such as a piston, on which the coil is mounted and may comprise at least one ferrofluid seal for guiding the movement of said moving part, that reduces the non-linearities in the movement of the moving part in the transducer;

the ferrofluid seal may be placed between the moving part and the magnet element's coil-facing face in the region where the magnetic flux gradient is the largest, so it can help concentrate the field in that region;

said ferrofluid seal may be arranged in use to act as a thermal bridge allowing the heat created by the coil to flow therethrough and be dissipated to the atmosphere, to improve the heat dissipation in the coil motor transducer structure;

the coil motor transducer structure may further comprise a moving part, such as a piston, that is at least partially hollow so as to define a volume therein, and the coil motor transducer structure may further comprise an external magnetic element and an internal magnetic element, the latter being placed in the volume defined in the moving part; which improves the compactness of the transducer.

Furthermore, by using bonded magnets, elaborate cross section shapes and optimized magnetization of the structure can be realized, allowing for more compact coil motor structures.

Even though it is not easy yet to obtain Nd—Fe—B bonded magnets with a magnetization higher than 0.9 T, the possibility to realize almost any shape allows ingenious magnetic structures to be made in order to compensate.

In particular, the ellipsoidal structure permits the creation of an intense magnetic field concentrated on the voice-coil trajectory, which is the aim of a leakage free loudspeaker motor.

Finally, the whole structure is directly injected in a mold and no assembly of annular magnets is needed, which is a strong advantage in case of mass production.

The invention also relates to a method of manufacturing a magnetic element for use in a coil transducer motor according according to the present invention, the method including the steps of:

providing a compound of magnetic powder and a binding material, such as a thermosetting resin, in liquid state in a mould, then;

magnetizing said compound whilst in liquid state in said mould, such that said compound generates said curvilinear path whilst in said liquid state; then setting said compound to form said element.

The invention also relates to a loud speaker incorporating a voice coil motor structure according to the invention for inducing vibrations to a diaphragm (13) that is fixed towards an end of the moving part (21) of the coil transducer motor structure (20) thereon.

The present invention will now be described by way of example only and with reference to the accompanying drawings, in which:

BRIEF DESCRIPTION OF THE DRAWINGS

FIG. 1 is a schematic representation of a cross-section of a voice-coil transducer motor assembly comprising an external magnetic field generating means made from bonded magnets;

FIG. 2 is a schematic representation of a cross-section of a voice-coil transducer motor assembly comprising external and internal magnetic field generating means made from bonded magnets;

DESCRIPTION OF PREFERRED EMBODIMENTS

Figure 3:
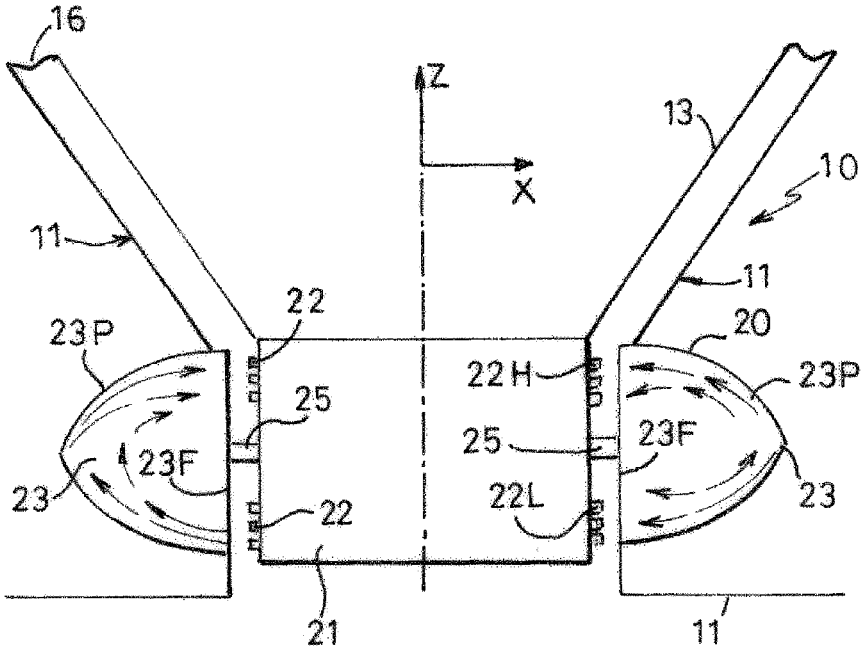
FIG. 3 is a schematic representation of a cross-section of a voice-coil transducer motor assembly comprising an external magnetic field generating means made from bonded magnets and ferrofluid seals.

Referring to the figures and for the moment in particular to FIG. 1, a crosscut through a loudspeaker 10 is illustrated. This loudspeaker 10 essentially comprises a receiving part 11, and a voice-coil transducer motor structure 20 adapted to move along an axis Z so as to induce movement to a diaphragm 13 attached to the diaphragm 13 by its lower edge.

The diaphragm 13 is maintained at a distance along an axis x from the receiving part 11 by suspension means in order to give it a conical shape. The x axis is defined by the intersection of a radial plane and a longitudinal plane that includes the Z axis. These suspension means comprise an internal suspension usually known as a spider 15 and placed towards its lower edge and an external suspension 16 placed towards its higher edge.

In addition to their guiding function, these suspension elements 15, 16 also serve to protect the voice-coil 22 from dust and particles that could get inside the voice-coil transducer motor structure 20 and stick to it electrostatically because of the magnetic field generated in the loudspeaker 10.

These suspension elements 15, 16 can also comprise ferrofluid seals to guide the moving part 21, and in particular comprise ferrofluid seals 25 to replace the spider as shown on FIG. 3 that will be described in more detail later in the description.

The voice-coil transducer motor structure 20 comprises a moving part 21 on which a voice-coil 22 is wound therearound and at least one magnetic element 23 arranged in use to provide a path for magnetic flux between an upper 22H and a lower 22L path of the winding of said voice-coil 22.

The upper 22H and lower 22L windings comprise at least one winding, and preferably less than three.

The moving part 21 or mandrel can be in the shape of a cylinder and can be full or at least partially hollow so as to define a volume therein.

As shown on FIG. 1, the magnetic element 23 is of hemi-ellipsoidal cross section or at least the magnetic path is of hemi-ellipsoidal shape.

In a particular embodiment, the cross section could be hemi-circular or at least the magnetic path may be of hemi-circular shape.

The magnetic element 23 comprises a peripheral edge 23P that follows a hemi-ellipsoidal line, or in particular a hemi-circular line, and a coil-facing face 23F adapted to face the voice coil 22, so that the magnetic field is perpendicular to it.

The magnetic element 23 can surround the moving part 21 or in the case of a hollow moving part 21, be placed inside the volume defined therein.

By placing the magnetic element 23 inside the moving part 21, a more compact voice coil transducer motor structure 20 can be obtained. Moreover, when using ferrofluid seals to guide the moving part 21, having the magnetic element 23 inside the moving part is advantageous because it allows the ferrofluid seal to slide all the way along the z axis of the moving part 21.

As shown in FIG. 2, a voice coil motor structure 20 can comprise an external magnetic element 23E and an internal magnetic element 23I placed in the moving part 21.

Such a structure is more efficient, especially when double coil windings 23H,23L are used.

According to the invention, the magnetic element 23 is made of bonded magnets.

This allows the magnetization of the structure to be done in such a way that the magnetic path through it is always at a tangent to the peripheral edge 23P, except on the coil-facing face 23F where it is perpendicular to the edge in order to avoid magnetic flux leakages. The magnetic field created by the motor is then concentrated on the voice-coil 22 path in order to increase the efficiency of the loudspeaker 10.

Although not shown in the figures, several magnet elements and corresponding coils can be stacked along the axis Z. Such an arrangement is advantageous when high energy movement is required such as in shaker applications, the leakage free properties of the structures allowing for more compact motors without having crosstalk between the adjacent generated magnetic fields.

The bonded magnetic elements 23 can be made of a compound that comprises a magnet powder mixed with a binding material, usually a fluid such as a thermosetting resin in a preforming molding die to form a bonded magnet of the desired shape such as a hemi-elliptical shape as shown on FIG. 1. These bonded magnets elements 23 can be made for example one of the methods described in the patent document GB2314799.

The magnet powder material, that preferably has anisotropic magnetization properties, can be chosen in the list of materials comprising ferrite material or rare-earth materials that have higher magnetic properties than the ferrite materials, such as alloys of Nd—Fe—B, Sm—Co and Sm—Fe—N.

The preforming molding die can be made of a non-magnetic material or a soft-magnetic material or a combination thereof to ensure that a high magnetic field can enter into the mold without any disturbance.

The binding material is chosen amongst a list of materials that suit best the conditions of compression molding that is desired in the method of manufacturing the bonded magnet element.

One non-limiting example of manufacture of such an element can comprise the following steps:

The method of manufacturing a bonded magnet element comprises the steps of:

mixing the magnet powder material with the thermosetting resin at a temperature that is above a set temperature for the resin to be in a liquid state to form a compound;

having the preforming molding die filled with the compound and preferably having heating means provided on the die for the compound to be kept above the set temperature and more preferably to reach a temperature at which the viscosity of the compound is the lowest;

having a magnetic field generated by a magnetizing means and preferably pressure applied to the compound in the molding die for the magnet powder material to align along the magnetic field lines created by the magnetizer and;

having the molding die removed after the compound is cooled down and compact.

Use of bonded magnets allows for elaborate cross-sectional shapes such as hemi-ellipsoidal and hemi-circular and optimized magnetization of the structure. The fluid is directly injected in a mold and the product is formed in one piece so that, unlike the multiple sintered magnet element version no assembly is needed after the bonded magnetic element 23 is formed. Moreover, the optimized magnetization lowers the need for cooling in the voice-coil transducer motor structure 20, since for an equivalent energy used to move the diaphragm 13, lower magnitudes of magnetic fields are needed.

The magnetic field created by these structures presents a high gradient around the semi-height of their inner face.

More generally, a high gradient is observed around the point of inversion of the magnetic flux, which can be distinct from the semi-height point when having dissymmetrical cross-sectional shapes or dissymmetrical curvilinear magnetic paths.

This high magnetic field gradient permits the use of ferrofluid seals 25 to guide the moving part 21 and can replace the spider 15 of FIG. 1. One possible ferrofluid seal is of the type disclosed in the patent document FR2892887 incorporated in its entirety herein by reference.

As shown on FIG. 3, a ferrofluid seal 25 is placed in between the moving part 21 and the magnet element 23. The ferrofluid seal 25 is placed around the point where the magnetic flux gradient is the largest. In the symmetrical magnetic elements 23 shown in FIG. 3, the ferrofluid seal 25 takes place around the point of semi-height of the coil-facing face 23F.

Use of ferrofluid seals 25 can help avoid non-linearities in the movements of the moving part 21 in the coil transducer motor structure 20 that can be introduced by the suspension elements 15,16 usually made of elastomer.

Moreover, ferrofluid seals 25 act as thermal bridges, allowing the heat generated by the current circulating in the coil to flow through and be dissipated in the magnetic element 23 and in the receiving part 11, that have better thermal exchanges coefficients than the moving part 21, usually made in a light material such as cardboard.

Figure 4A:
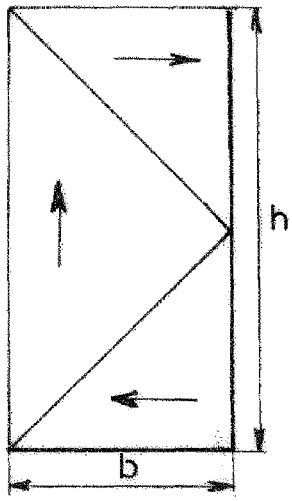
FIG. 4*a* and FIG. 4*b* are respective cross-sections of a rectangular section three sintered magnet voice-coil transducer motor structure and of an elliptical section bonded magnet voice coil transducer motor structure.
Figure 4B:
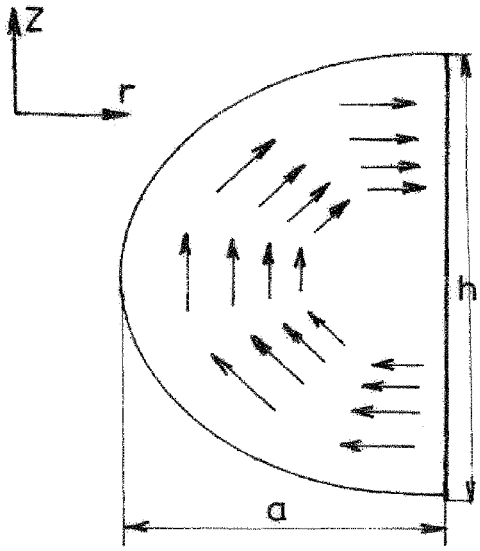

FIGS. 4*a* and 4*b* show respective cross-sections of a conventional rectangular section three-piece sintered magnet voice coil transducer motor structure 20 and of an elliptical section bonded magnet voice coil transducer motor structure 20 according to the present invention on the basis of which two-dimensional calculations have been undertaken, which results are discussed herebelow.

A 2D Coulombian approach is used to calculate analytically the magnetic field created by the structures illustrated in FIGS. 4*a* and 4*b*. The basis of the model used for the calculation is disclosed in "Three-dimensional analytical optimization of permanent magnets alterned structure", IEEE Trans. Magn., vol 34, pp. 242-247, January 1998 by F. Bancel and G. Lemarquand and disclosed in "Rare-earth Iron Permanent Magnets, ch. Magnetomechanical devices, Oxford Science Publications, 1996 by J. P. Yonnet.

The elliptical section bonded magnet voice coil transducer motor structure 20 is discretized, in seven magnets of equal angular section, in order to enable analytical calculations of the magnetic field to be performed.

A magnetic charges model is used to describe the magnets. The surface charge density σ* a of each triangular magnet is defined with the magnetization $\vec{J}$ and then calculated such as:

$$\sigma^* = \vec{J} \cdot \vec{n} \qquad \text{Equation (2)}$$

where $\vec{n}$ is the outwards surface normal vector.

The magnetization is considered to be always substantially parallel to the outer edge of the ellipsoid in order to avoid magnetic flux leakages. As a result, the magnetization is uniform for each magnet, which gives:

$$div\vec{J} = \rho^* = 0 \qquad \text{Equation (3)}$$

where ρ* represents the volume charge density. Nevertheless, for the real structure, volume charges should be taken into account, as in "Using Coulombian approach for modeling scalar potential and magnetic field of a permanent magnet with radial polarization", IEEE Trans. Magn., vol. 43, pp 1261-1264, April 2007 by H. L Rakotoarison, J. P. Yonnet and B. Delinchant.

The magnetic field, $\vec{B}$, created by each magnet surface at any point M(x, z) is given in 2D by:

$$\vec{B} = \frac{\sigma^*}{4\pi} \int_{yi=-\infty}^{yi=+\infty} \int_{zi} \frac{\overrightarrow{PM}}{|\overrightarrow{PM}|^3} dy_i dz_i \qquad \text{Equation (4)}$$

where P is a point on the considered surface i.

Overall, the magnetic field created by the fourteen surfaces, two for each magnet, has to be calculated independently then summed to obtain the total magnetic field created by the ellipsoidal structure, since the superposition theorem applies. The same method is used to calculate the magnetic field created by the three magnets structure. It can be noted that for the rectangular structure, if θ equals 45° (i.e. a=h), only the two surfaces facing the voice-coil have to be taken into account. This is due to the fact that the remaining surface charge density is equal to zero on the two other magnet interfaces.

The calculations have been undertaken on these two structures that have equal dimensions h along the z-component, and different dimensions a and b along the x-component chosen to provide both structures with the same cross section area.

The magnetization values for each magnet element are equal to 1 Tesla, that is in the vicinity of the maximum value of magnetization that can be obtained for Nd—Fe—B bonded magnet elements.

Figure 5:
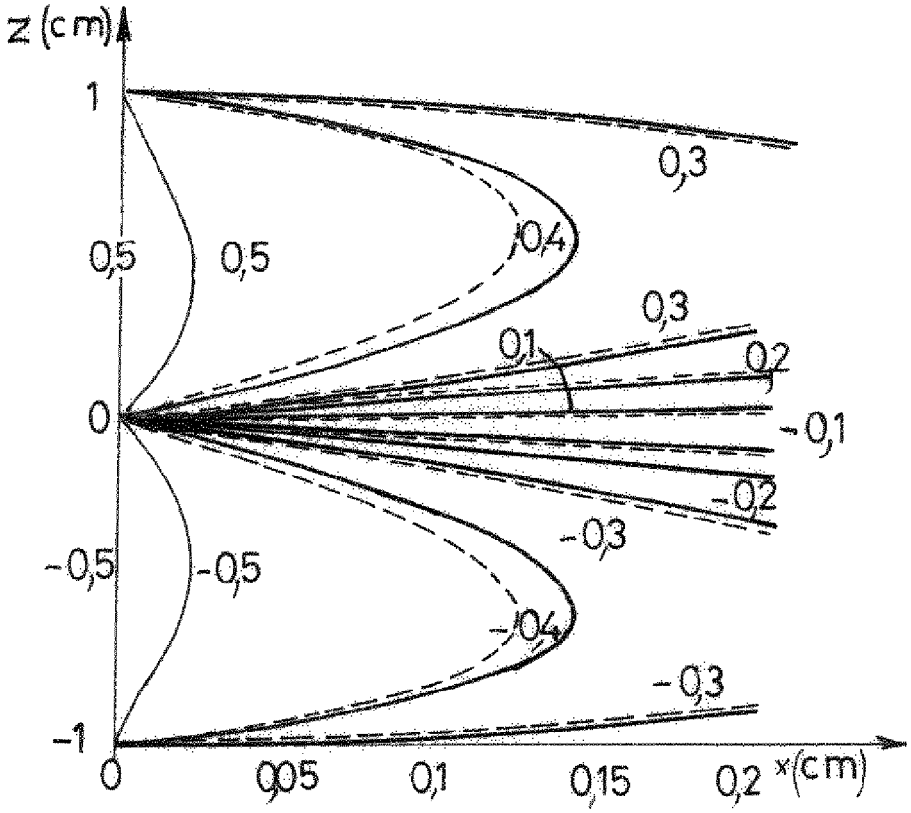
FIG. 5 is a graph showing results of calculation comparing the magnitude of the magnetic fields in the x-component of the voice-coil transducer motor structures of FIGS. 4*a* and 4*b;*

FIG. 5 presents the magnitude isolines of the x-component of the magnetic field created in front of the magnet element for both structures. It is clear that the hemi-ellipsoidal magnet elements 23 gives better results than the rectangular one: the magnetic field generated is more intense and shows a better symmetry around the rest position of the voice-coil (i.e. z equals 0.5 and −0.5 cm).

Figure 6:
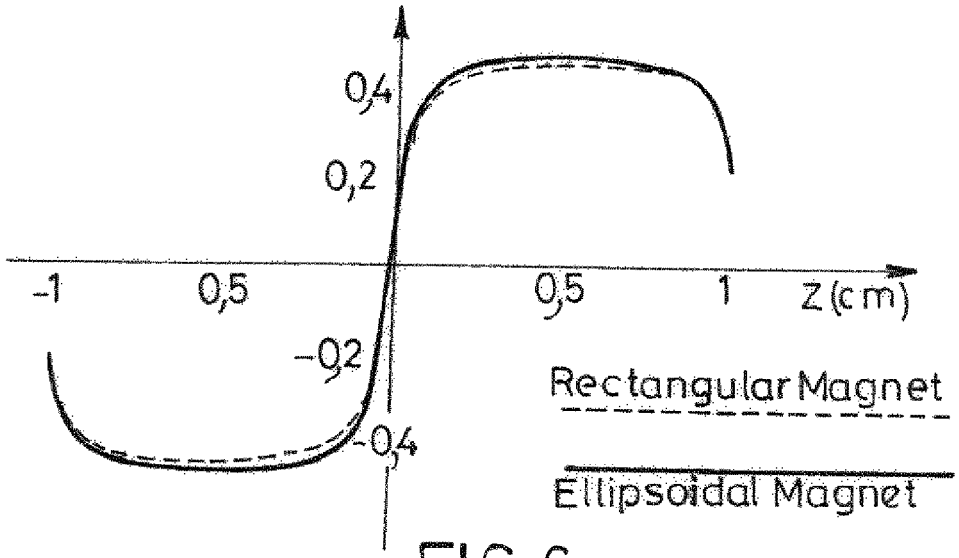
FIG. 6 is a graph showing results of calculation comparing the magnitude of the x-component of the magnetic field relative to the Z-component in each of the voice coil transducer motor structures of FIGS. 4*a* and 4*b;*

FIG. 6 compares the evolution of the magnetic field in front of the whole height of the magnetic element structure (i.e. z equals −1 cm to z equals 1 cm) at a distance from the magnet equal to 0.5 mm along the x-component for both structures.

Once again, it clearly shows that the ellipsoidal structure gives better results (i.e. intensity and symmetry around the rest position of the coil) than the rectangular one of equal magnet volume.

The symmetry around the rest position and the uniformity of the induction across the whole voice-coil trajectory is an important characteristic for an accurate loudspeaker motor.

The length of this trajectory is determined by the intended acoustical pressure at low frequencies, giving the maximal needed acoustic flow, and thus, the maximal required excursion for a given radiating surface.

For example, to obtain a sound pressure level of 95 dB at 1 m on axis and at 100 Hz with a loudspeaker 10 having a 5 cm radius membrane, the required excursion is 2 mm. If we consider this oscillation range around the rest position, the difference of magnetic field intensity between the lowest and the highest position of the coil is 1% for the ellipsoidal structure and 3% for the rectangular one, which is significant for a loudspeaker. The uniformity of the magnetic field on the voice-coil path has a direct impact on the linearity of the transducer and thus, on its sound reproduction fidelity.

Figure 7:
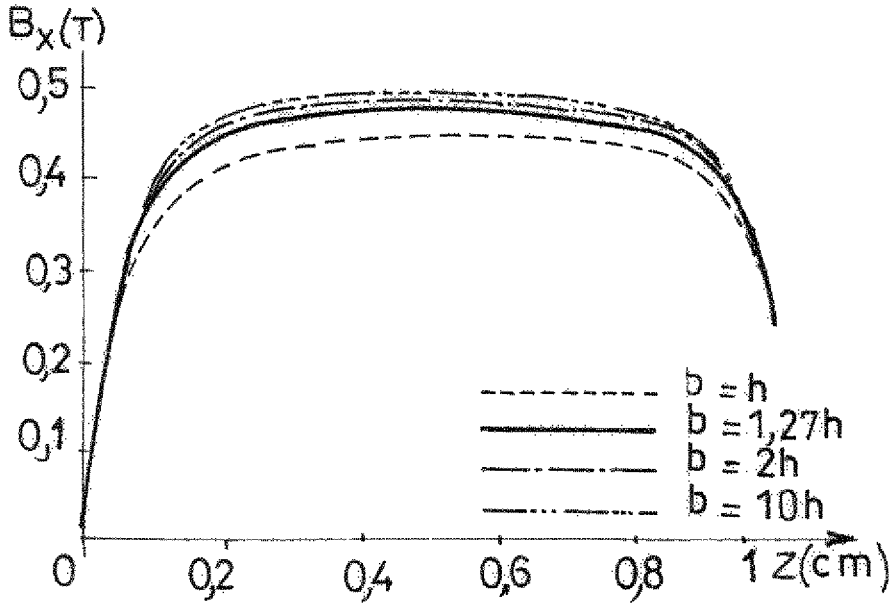
FIG. 7 is a graph showing the effect of the ratio between the lengths of the major axis b and the minor axis h of an ellipsoidal structure on the generated magnetic field.

FIG. 7 shows the effect of the geometry of the elliptical structure of the magnet element 23 by calculating the generated magnetic field as a function of the ratio between the major axis b and the minor axis h of the ellipsoid, $$R = \frac{b}{h}.$$

What is claimed is:

1. A coil transducer motor structure comprising:

at least one coil;

at least one magnetic element arranged in use to provide a path for magnetic flux between ends of said coil, wherein the magnetic element comprises a bonded magnetic structure comprising only one bonded magnet of hemi-ellipsoidal cross-section providing a curvilinear path therethrough for said magnetic flux.

2. The coil transducer motor structure according to claim 1, wherein said curvilinear path is hemi-ellipsoidal.

3. The coil transducer motor structure according to claim 2, wherein said hemi-ellipsoidal path or structure in cross-section is a ratio R of 2 between the lengths of the major axis and the minor axis.

4. The coil transducer motor structure according to claim 1, wherein the magnetic element includes a side positioned to face the at least one coil, and the magnetic element is magnetized in such a manner that said magnetic path is always substantially tangential to a peripheral edge of said magnetic element, except on the side facing the coil, where it is perpendicular to the edge of the coil-facing face.

5. The coil transducer motor structure according to claim 1, wherein the magnetic element consist of the only one bonded magnet.

6. The coil transducer motor structure according to claim 1, wherein magnetization of the magnetic element is realized when the material constituting the bonded magnet is still liquid.

7. The coil transducer motor structure according to claim 1, wherein a preforming molding die, configured to contain the material constituting the bonded magnet element, is made of a non-magnetic material or a soft-magnetic material or a combination thereof to ensure that a high magnetic field enters into the mold without any disturbance.

8. The coil transducer motor structure according to claim 1, wherein the bonded magnet element comprises a rare-earth material based alloy and is preferably chosen between Nd—Fe—B, Sm—Co and Sm—Fe—N.

9. The coil transducer motor structure according to claim 1, further comprising a moving part comprising a piston on which the coil is mounted, wherein the coil transducer motor structure further comprises at least one ferrofluid seal positioned and configured to guide the movement of said moving part.

10. The coil transducer motor structure according to claim 9, wherein the ferrofluid seal is placed between the moving part and the coil-facing face of the magnetic element in the region where the magnetic flux gradient is the largest.

11. The coil transducer motor structure according to claim 9, wherein said ferrofluid seal is arranged in use to act as a thermal bridge allowing the heat created by the coil to flow therethrough and be dissipated to atmosphere.

12. The coil transducer motor structure according to claim 1, further comprising a moving part comprising a piston at least partially hollow so as to define a volume therein, wherein the coil transducer motor structure further comprises:

an external magnetic element, and an internal magnetic element positioned in the volume defined in the moving part.

13. A method of manufacturing a magnetic element for use in a coil transducer motor according to claim 1, the method including the steps of:

providing a compound of magnetic powder and a binding material in liquid state in a mould; then magnetizing said compound whilst in liquid state in said mould, such that said compound generates said curvilinear path whilst in said liquid state; then setting said compound to form said element.

14. A loud speaker incorporating a coil transducer motor structure according to claim 1, the coil transducer motor positioned and configured to induce for inducing vibrations to a diaphragm that is fixed towards an end of the moving part of the coil transducer motor structure thereon.

15. The method of claim 13, wherein the binding material comprises a thermosetting resin.

* * * * *

UNITED STATES PATENT AND TRADEMARK OFFICE

CERTIFICATE OF CORRECTION

PATENT NO. : 8,422,726 B2
APPLICATION NO. : 12/989849
DATED : April 16, 2013
INVENTOR(S) : Lemarquand et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 247 days.

Signed and Sealed this
Eighth Day of September, 2015

Michelle K. Lee

Michelle K. Lee
*Director of the United States Patent and Trademark Office*